US006684463B1

(12) United States Patent
Yang

(10) Patent No.: US 6,684,463 B1
(45) Date of Patent: Feb. 3, 2004

(54) STRUCTURE OF AN ADJUSTING BUCKLE FOR SHOULDER STRAPS

(76) Inventor: Wen Yang, PO Box 82-144, Taipei (TW)

( * ) Notice: Subject to any disclaimer, the term of this patent is extended or adjusted under 35 U.S.C. 154(b) by 0 days.

(21) Appl. No.: 10/193,908

(22) Filed: Jul. 15, 2002

(51) Int. Cl.[7] ..... A44B 11/25; A44B 11/02

(52) U.S. Cl. ..... 24/197; 24/198; 24/200; 24/163 K

(58) Field of Search ..... 2/312, 321, 322, 2/67, 73, 78.2, 109, 267, 300, 323, 336, 338; 24/66.9, 163 K, 163 R, 168, 169, 1, 197, 198, 200, 298, 300–302; 63/3, 3.1, 3.2, 40; 40/627, 640; 224/163, 222; 450/86

(56) References Cited

U.S. PATENT DOCUMENTS

| | | | | | |
|---|---|---|---|---|---|
| 192,477 | A | * | 6/1877 | Wright | 24/21 |
| 629,486 | A | * | 7/1899 | Bodwell | 24/310 |
| 806,576 | A | * | 11/1905 | Fishel | 24/312 |
| 1,232,546 | A | * | 7/1917 | Holden | 24/191 |
| 2,480,874 | A | * | 9/1949 | Neumann | 24/168 |
| 2,614,223 | A | * | 10/1952 | Bedford, Jr. | 24/198 |
| 3,251,108 | A | * | 5/1966 | Harrison | 24/166 |
| 4,052,773 | A | * | 10/1977 | Nesbitt | 24/163 K |
| 4,653,123 | A | * | 3/1987 | Broersma | 2/425 |
| 4,761,861 | A | * | 8/1988 | Peles | 24/196 |
| 6,038,747 | A | * | 3/2000 | Hamilton et al. | 24/164 |

FOREIGN PATENT DOCUMENTS

| | | | | |
|---|---|---|---|---|
| EP | 0 608 580 A1 | * | 8/1994 | 24/163 R |
| FR | 387022 | * | 2/1908 | 24/163 R |
| FR | 1282682 | * | 12/1967 | 24/163 R |
| GB | 2 099 493 | * | 12/1982 | 24/163 R |

* cited by examiner

*Primary Examiner*—William Miller
*Assistant Examiner*—Ruth C. Rodriguez
(74) *Attorney, Agent, or Firm*—Leong C. Lei

(57) ABSTRACT

A structure of an adjusting buckle for a shoulder strap includes an integrally formed adjusting buckle body and a press-release button, wherein the adjusting buckle body has two inner slots and two outer slots, the press-release button has a bottom formed with two protuberances configured and positioned to engaged the two outer slots, and the shoulder strap is made of silicone and passes through the two inner slots, whereby when the press-release button is engaged with the adjusting buckle body, the shoulder strap will be kept in a firm position.

2 Claims, 6 Drawing Sheets

STRUCTURE OF AN ADJUSTING BUCKLE FOR SHOULDER STRAPS

BACKGROUND OF THE INVENTION

1. Field of the Invention

This invention is related to an improvement in the structure of an adjusting buckle for a shoulder strap, and in particular to one which is associated with a press release button to provide a firm positioning of a shoulder strap.

2. Description of the Prior Art

Various kinds of sleeveless clothing are very popular for women in summer, for general living or formal situations, but the shoulder strap of the wearer's brassiere or the like beneath the sleeveless clothing often falls down onto the arm, thus causing embarrassment and inconvenience to the wearer. A shoulder strap made of plastic has been developed to prevent the strap from being visible if this situation should arise. However, this kind of plastic strap does not permit air to pass through it, and will stick to the skin. The reason why the shoulder strap is loosened is due to the buckle.

Referring to FIGS. 2 and 3, the conventional adjusting buckle for a shoulder strap 10 is shaped as a numeral 8 with two holes 11 for the strap 30. The inner side of the holes of the adjusting buckle 10 is provided with slip-proof lines 13. However, the slip-proof lines 13 cannot effectively keep the position of the strap, so that the strap will often be loosened. Therefore, it is an object of the present invention to provide an improvement in the adjusting buckle of the shoulder strap to obviate and mitigate the above-mentioned drawbacks.

SUMMARY OF THE INVENTION

This invention is related to an improvement in the structure of an adjusting buckle for a shoulder strap, and in particular to one which is associated with a press release button to provide a firm positioning of a shoulder strap.

It is the primary object of the present invention to provide an improvement in the structure of an adjusting buckle for a shoulder strap which includes an integrally formed adjusting buckle body and a press-release button, wherein the adjusting buckle body has two inner slots and two outer slots, the press-release button has a bottom formed with two protuberances configured and positioned to engaged the two outer slots, and the shoulder strap is made of silicone and passes through the two inner slots, whereby when the press-release button is engaged with the adjusting buckle body, the shoulder strap will be kept in a firm position.

The foregoing object and summary provide only a brief introduction to the present invention; To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
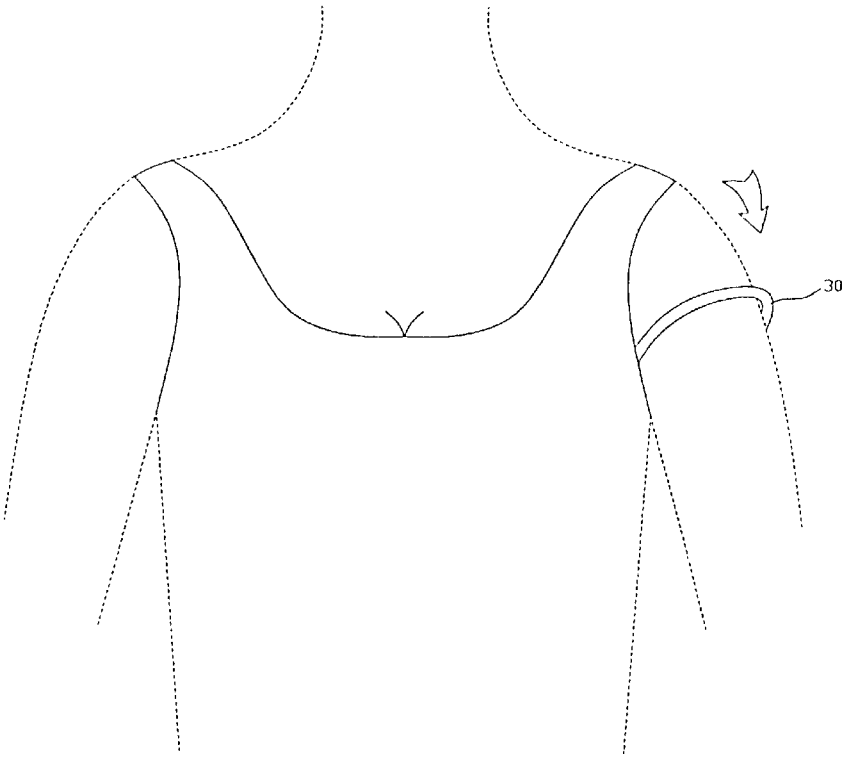
PRIOR ART FIG. 1
FIG. 1 shows the shoulder strap falling down from the shoulder.
Figure 3:
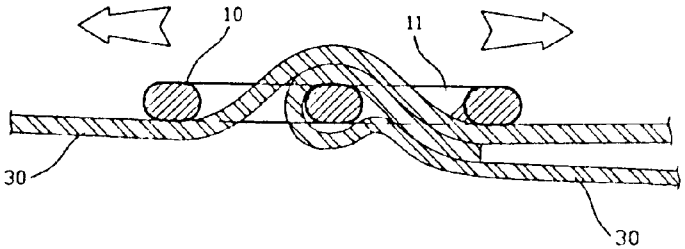
PRIOR ART FIG. 3
FIG. 3 is a sectional view showing the relationship between the conventional adjusting buckle and the strap.
Figure 2:
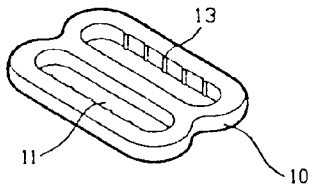
PRIOR ART FIG. 2
FIG. 2 is a perspective view of a conventional adjusting buckle for a shoulder strap.
Figure 4:
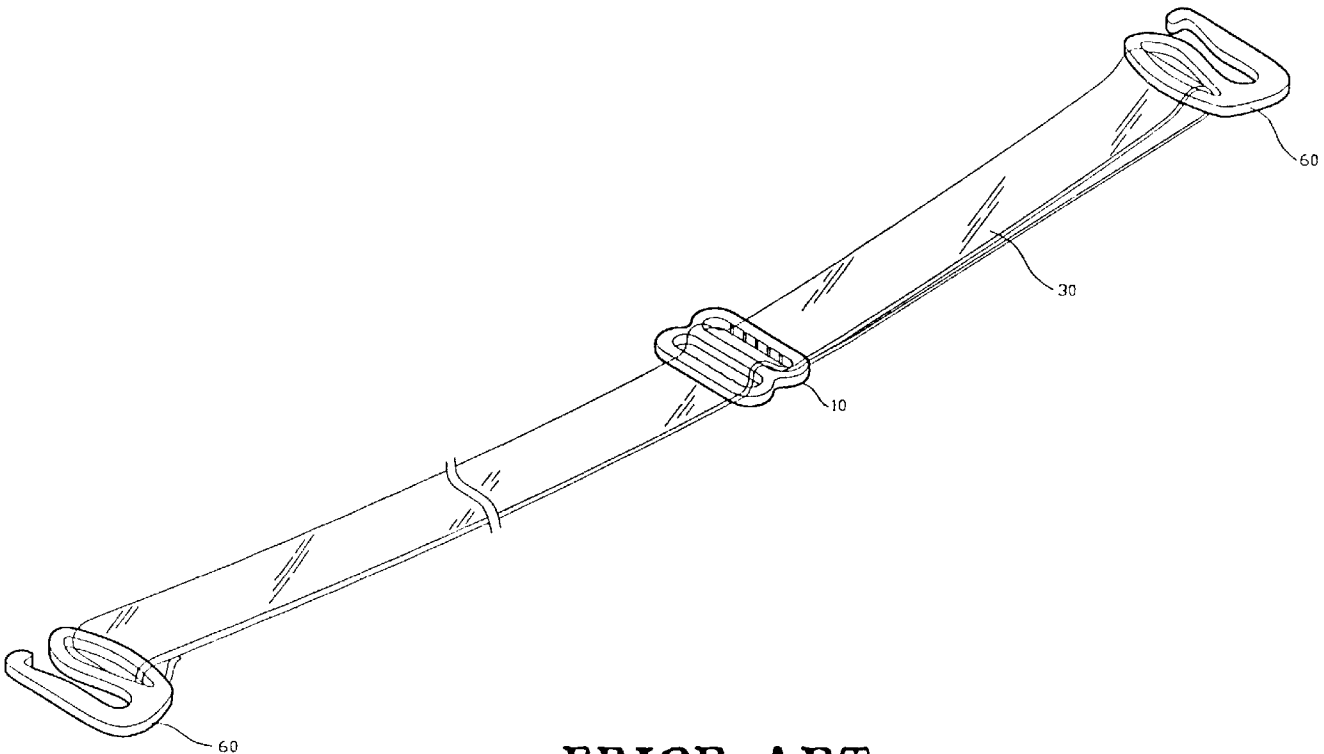
PRIOR ART FIG. 4
FIG. 4 is a perspective view showing the connection between the adjusting buckle and the shoulder strap.
Figure 6:
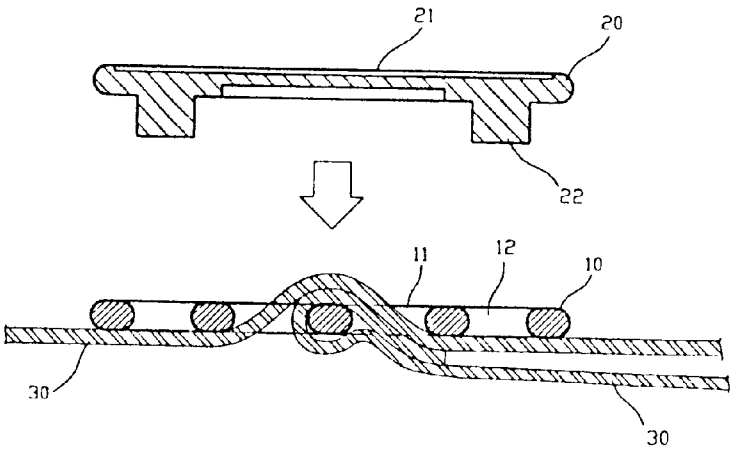
FIG. 6 is an exploded sectional view of the present invention.
Figure 5:
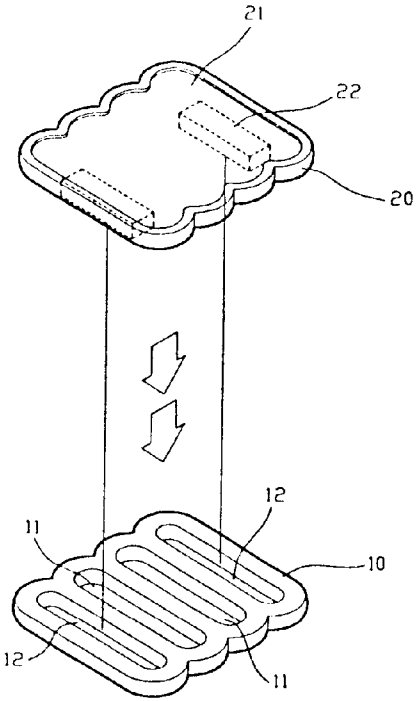
FIG. 5 is an exploded view of the present invention.
Figure 7:
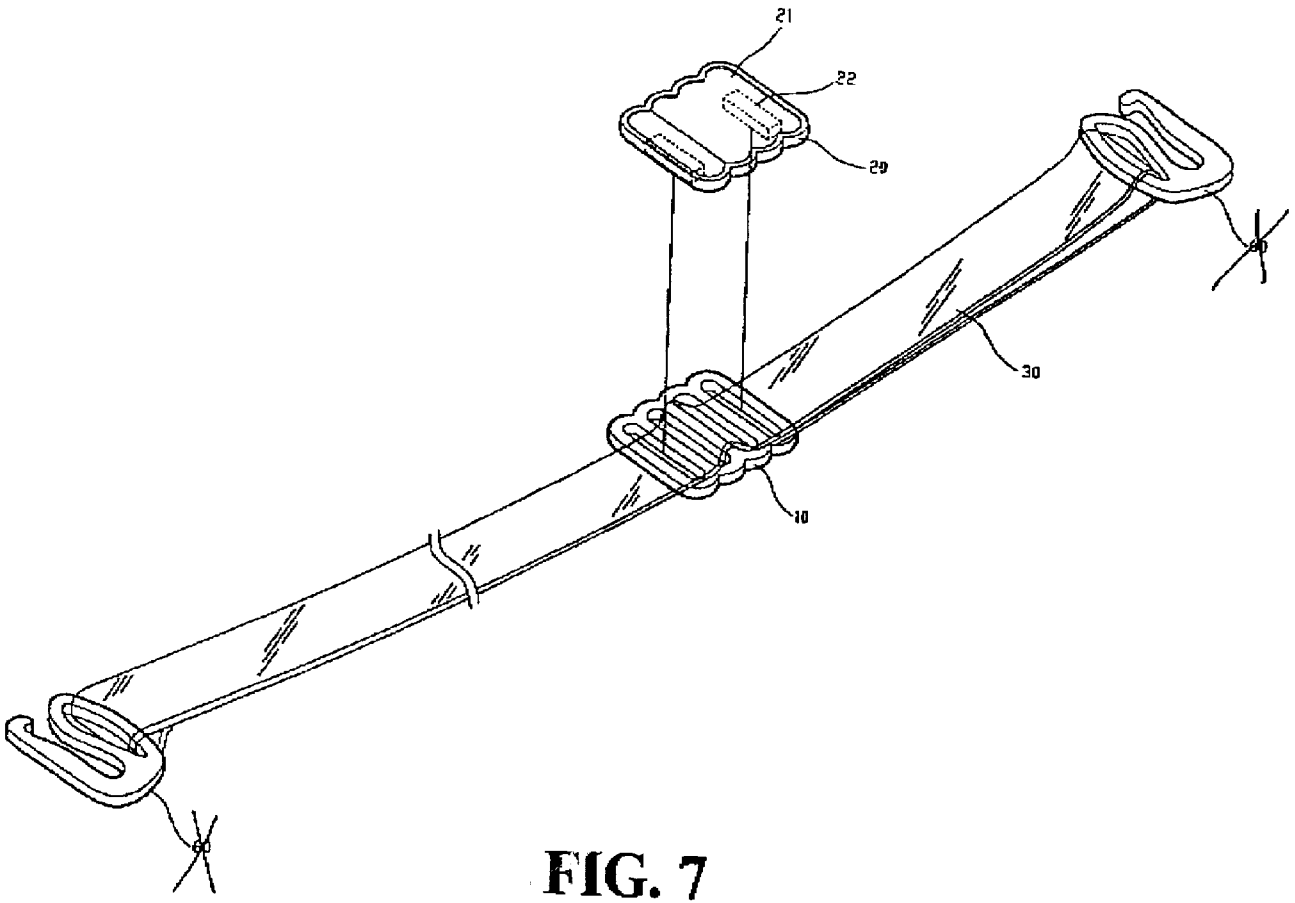
FIG. 7 is a perspective view showing the connection between the present invention and the shoulder strap.

With reference to the drawings and in particular to FIGS. 5, 6 and 7 thereof, the present invention comprises an adjusting buckle body 10 and a press release button 20, which are engaged with a shoulder strap 30. The shoulder strap 30 is made of silicone, and thus there will be static between the strap and the skin, thus allowing the wearer to feel comfortable, as this effect will enable the strap to be firmly against the skin without any discomfort.

The adjusting buckle body 10 has two inner slots 11 and two outer slots 12. The press release button 20 has two protuberances 22 configured and positioned to engage with the two outer slots 12 of the adjusting buckle body 10, so that the press release button 20 when engaged with the adjusting buckle body 10 can keep the position of the shoulder strap 30.

Figure 8:
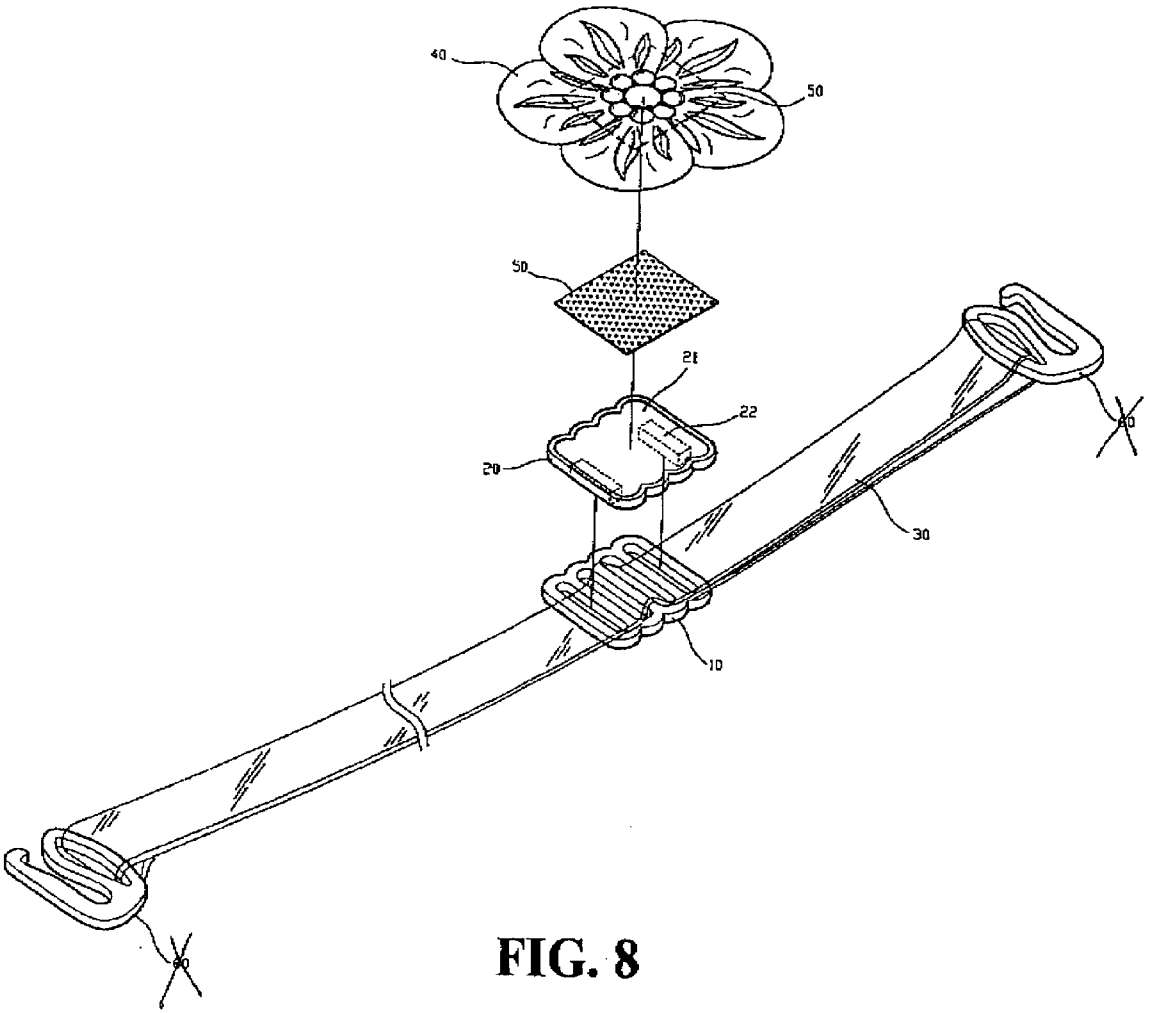
FIG. 8 illustrates another preferred embodiment of the present invention.

Referring to FIG. 8, the top of the press release button 20 has a recess 21 in which is adhered a piece of adhesive member 50 for engaging an adhesive member 50 of a decoration 40.

Referring to FIGS. 6 and 7, the adjusting buckle body 10 is formed with four slots 12 and 11. When the shoulder strap 30 passes through the two inner slots 11 of the adjusting buckle body 10, and then adjusts to a comfortable position, the press release button 20 is engaged with the adjusting buckle body 10 with the protuberances 22 of the former engaged with the outer slots 12 of the latter, thereby affixing the shoulder strap 30 in a firm position. Furthermore, the shoulder strap 30 is made of silicone, which may have various kinds of colors. Moreover, a decoration 40 may be attached to the top of the press release button 20 to increase beauty, and the wearer will not feel uncomfortable, even while perspiring.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of an adjusting buckle for a shoulder strap comprises an integrally formed adjusting buckle body and a press-release button, wherein said adjustable buckle body has a centerline, two inner slots are disposed to each side of the centerline and two outer slots are disposed on each side of said inner slots opposite to said centerline, said press-release button has a bottom formed with two protuberances configured and positioned to engage said two outer slots, sand said shoulder strap is made of silicone and passes through said two inner slots, whereby when said press-release button is engaged with said adjustable buckle body, said shoulder strap will be kept in a firm position by having the press-release button frictionally engaging the shoulder trap that passes through the inner slots.

2. The structure of an adjusting buckle for a shoulder strap as claimed in claim 1, wherein said press-release button has a top formed with a recess in which is fitted an adhesive member which is engageable with a second adhesive member of a decoration member.

* * * * *